US008102320B2

(12) United States Patent
Lin

(10) Patent No.: US 8,102,320 B2
(45) Date of Patent: Jan. 24, 2012

(54) ANTENNA STRUCTURE FOR PORTABLE ELECTRONIC DEVICE

(75) Inventor: Chi-Hsiung Lin, Taipei (TW)

(73) Assignee: Inventec Applicances Corp., Taipei (TW)

( * ) Notice: Subject to any disclaimer, the term of this patent is extended or adjusted under 35 U.S.C. 154(b) by 525 days.

(21) Appl. No.: 12/333,122

(22) Filed: Dec. 11, 2008

(65) Prior Publication Data

US 2009/0153419 A1 Jun. 18, 2009

(30) Foreign Application Priority Data

Dec. 13, 2007 (TW) ..... 96147777 A

(51) Int. Cl.
*H01Q 1/24* (2006.01)

(52) U.S. Cl. ..... 343/702

(58) Field of Classification Search ..... 343/700 MS, 343/702, 795, 767–730
See application file for complete search history.

(56) References Cited

U.S. PATENT DOCUMENTS

| | | | | |
|---|---|---|---|---|
| 6,025,816 | A * | 2/2000 | Dent et al. | 343/895 |
| 6,223,033 | B1 * | 4/2001 | Lusterman | 455/425 |
| 6,341,217 | B1 * | 1/2002 | Wong | 455/575.5 |
| 6,504,509 | B2 * | 1/2003 | Maatta | 343/702 |
| 6,525,696 | B2 * | 2/2003 | Powell et al. | 343/770 |

* cited by examiner

*Primary Examiner* — Huedung Mancuso
(74) *Attorney, Agent, or Firm* — Egbert Law Offices PLLC

(57) ABSTRACT

An antenna structure for portable electronic device includes an antenna and an electrical connection element. The portable electronic device includes a main body, a slotted section, a shaft, and a slot cover. The slot cover is coupled to the main body via the shaft, and the slot cover is located on the slotted section. The antenna is disposed on the slot cover, and the electrical connection element is coupled to the shaft and a printed circuit board mounted in the main body, so that the antenna is electrically coupled via the electrical connection element to the printed circuit board. Since the antenna disposed on the slot cover is not parallel with the printed circuit board, a clearance distance required between the antenna and the printed circuit board can be reduced to enable reduction of a volume of the portable electronic device.

8 Claims, 5 Drawing Sheets

ANTENNA STRUCTURE FOR PORTABLE ELECTRONIC DEVICE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an antenna structure, and more particularly to an antenna structure that is able to be disposed on a dustproof slot cover of a portable electronic device.

2. Description of Related Art Including Information Disclosed Under 37 CFR 1.97 and 37 CFR 1.98

Referring to FIGS. 1A and 1B, FIG. 1A is a perspective view of a conventional portable electronic device 1, and FIG. 1B is a sectional view taken along line A-A' of FIG. 1A showing a relative position of an antenna 12 to a printed circuit board 13 of the portable electronic device 1. The portable electronic device 1 may be a mobile phone, a personal digital assistant (PDA) or a global positioning system (GPS) and includes a housing 11, an antenna 12, a printed circuit board 13, and a leaf spring 14. The antenna 12, the printed circuit board 13, and the leaf spring 14 are all disposed in the housing 11. The antenna 12 is welded to an inner top surface 15 of the housing 11. The printed circuit board 13 is arranged on an inner bottom surface 16 of the housing 11 and parallel to the antenna 12, so that a predetermined vertical distance d is maintained between the printed circuit board 13 and the antenna 12. The leaf spring 14 electrically connects the antenna 12 to the printed circuit board 13.

In the above-described conventional portable electronic device 1, the antenna 12 must be vertically spaced from the printed circuit board 13 by the distance d, which is referred to as a "clearance distance", so as to avoid possible electromagnetic interference between the antenna 12 and the printed circuit board 13 that would lead to lowered signal reception and transmission efficiency of the antenna 12. Generally speaking, the predetermined distance d for the clearance distance is preferably more than 5 mm to effectively prevent the electromagnetic interference between the antenna 12 and the printed circuit board 13. As a result, the portable electronic device 1 has an increased volume due to the relatively large distance d for the clearance distance.

It is therefore a need to develop an improved antenna structure for portable electronic devices in an attempt to reduce the clearance distance required between the antenna and the printed circuit board without adversely affecting the signal reception and transmission efficiency of the antenna.

BRIEF SUMMARY OF THE INVENTION

One aspect of the present invention is to provide an improved antenna structure for a portable electronic device, with which an antenna is disposed on a dustproof slot cover of the portable electronic device to thereby locate at a position not parallel with a printed circuit board mounted in a main body of the portable electronic device. As a result, a clearance distance conventionally required between the antenna and the printed circuit board can be reduced to enable reduction of the volume of the portable electronic device.

Another aspect of the present invention is to provide an antenna structure for a portable electronic device, with which an antenna is disposed on a dustproof slot cover of the portable electronic device while the slot cover is coupled to a main body of the portable electronic device via a shaft, such that the dustproof slot cover can be rotated about the shaft to adjust the antenna to an optimal position for receiving and transmitting signals.

To achieve the above and other aspects, the antenna structure for portable electronic device according to the present invention includes an antenna and an electrical connection element. The portable electronic device includes a main body, a slotted section, a shaft, and a slot cover. The shaft couples the slot cover to the main body, and the slot cover is located on the slotted section. The antenna is disposed on the slot cover, and the electrical connection element is coupled to the shaft. A printed circuit board is mounted in the main body, so that the antenna disposed on the slot cover is electrically coupled via the electrical connection element to the printed circuit board. Since the antenna disposed on the slot cover is not parallel with the printed circuit board, a clearance distance conventionally required between the antenna and the printed circuit board can be reduced to enable reduction of a volume of the portable electronic device.

BRIEF DESCRIPTION OF THE SEVERAL VIEWS OF THE DRAWINGS

The structure and the technical means adopted by the present invention to achieve the above and other aspects can be best understood by referring to the following detailed description of the preferred embodiments and the accompanying drawings.

DETAILED DESCRIPTION OF THE INVENTION

Figure 1A:
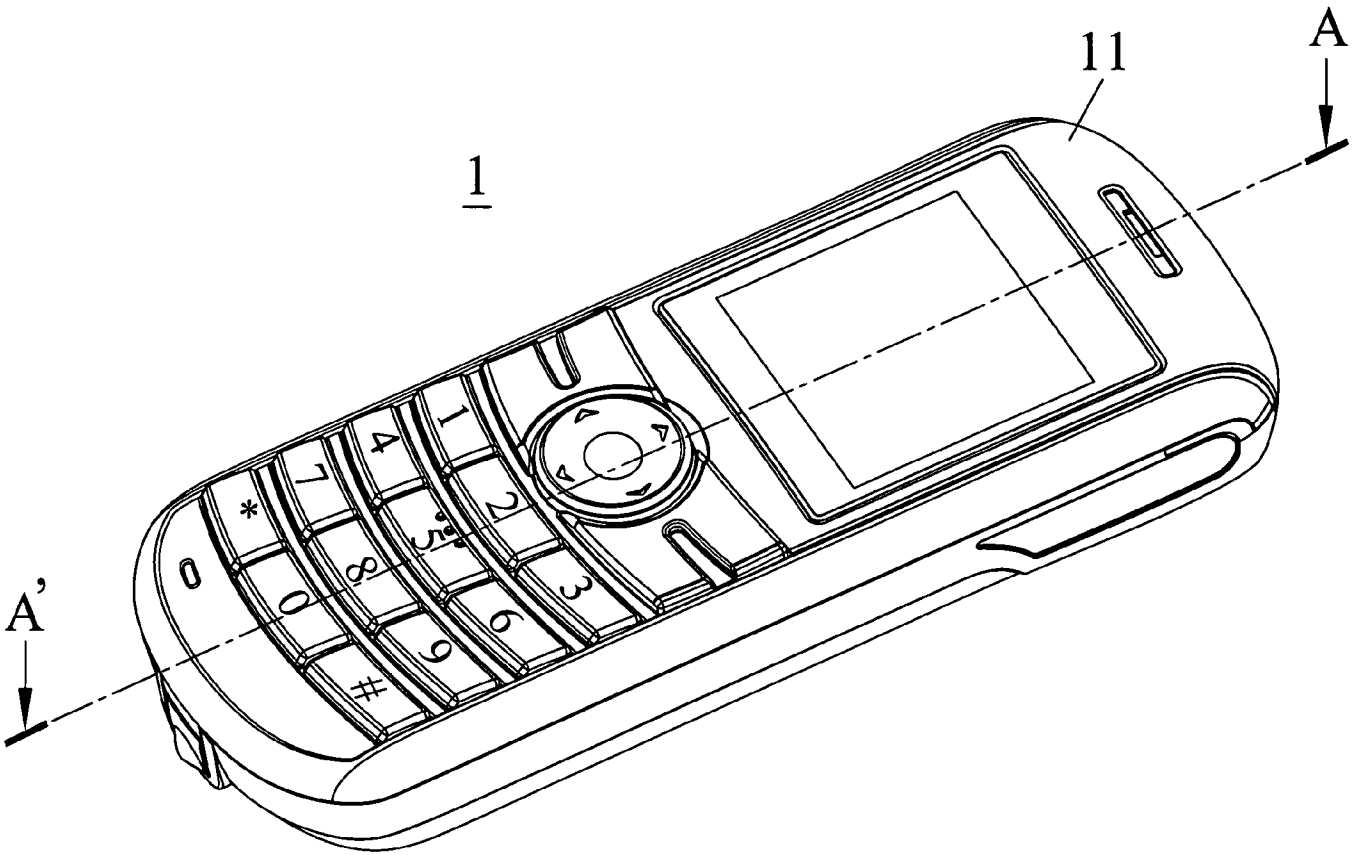
FIG.1A(PRIOR ART)
FIG. 1A is a perspective view of a conventional portable electronic device.
Figure 1B:
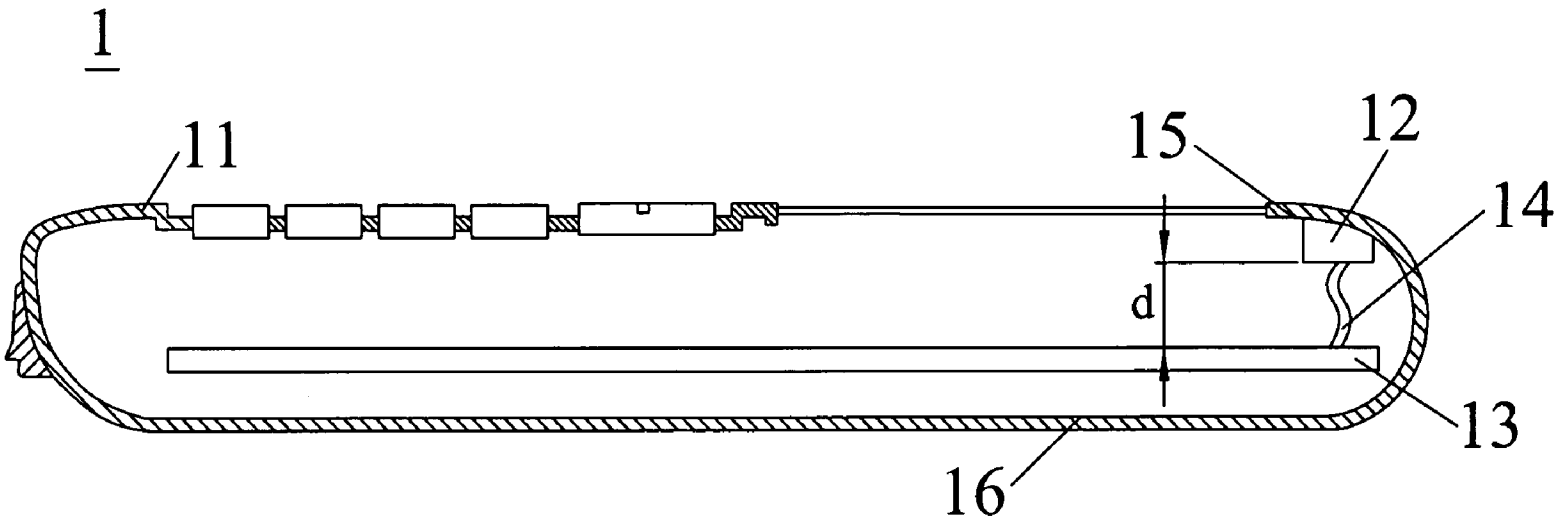
FIG.1B(PRIOR ART)
FIG. 1B is a sectional view taken along line A-A' of FIG. 1A showing a relative position of an antenna to a printed circuit board in the conventional portable electronic device.
Figure 2A:
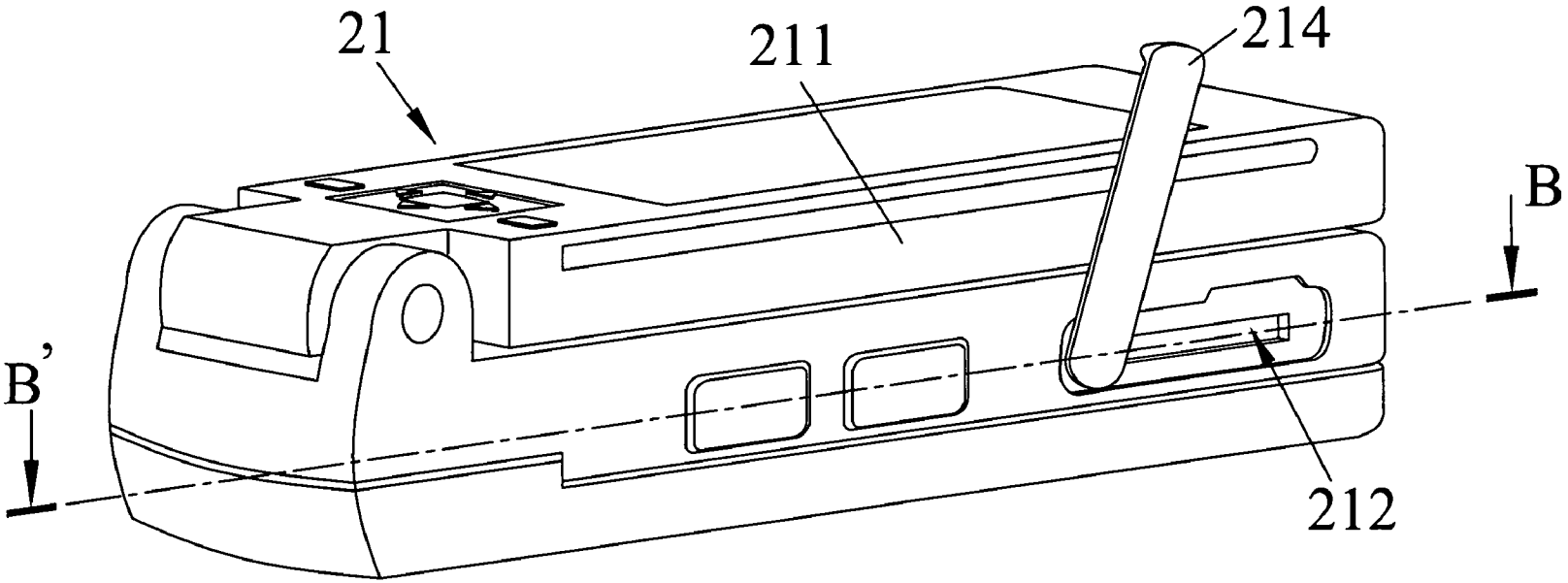
FIG. 2A is a perspective view showing an antenna structure for a portable electronic device according to a preferred embodiment of the present invention.
Figure 2B:
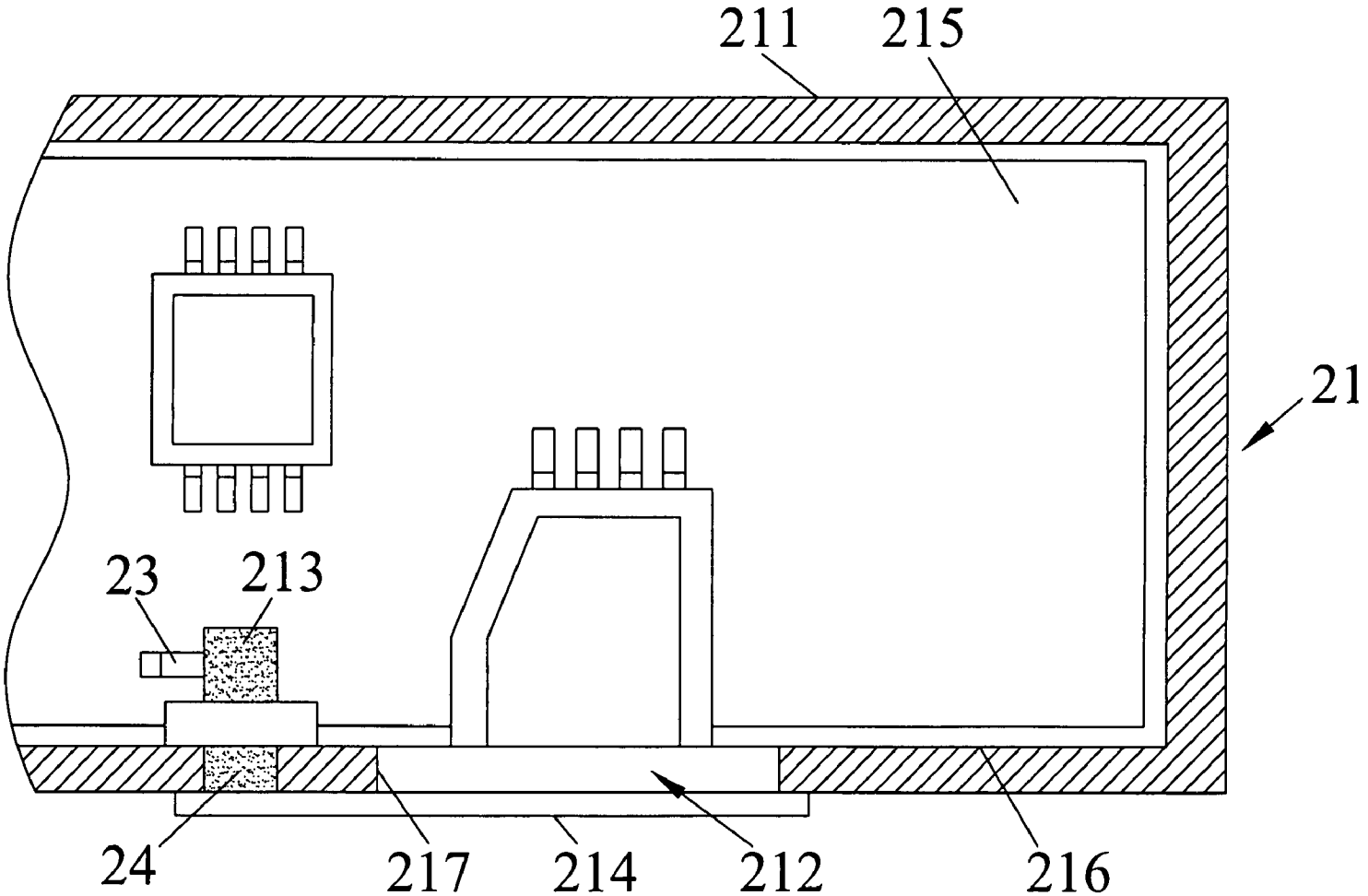
FIG. 2B is a sectional view taken along line B-B' of FIG. 2A.
Figure 2C:
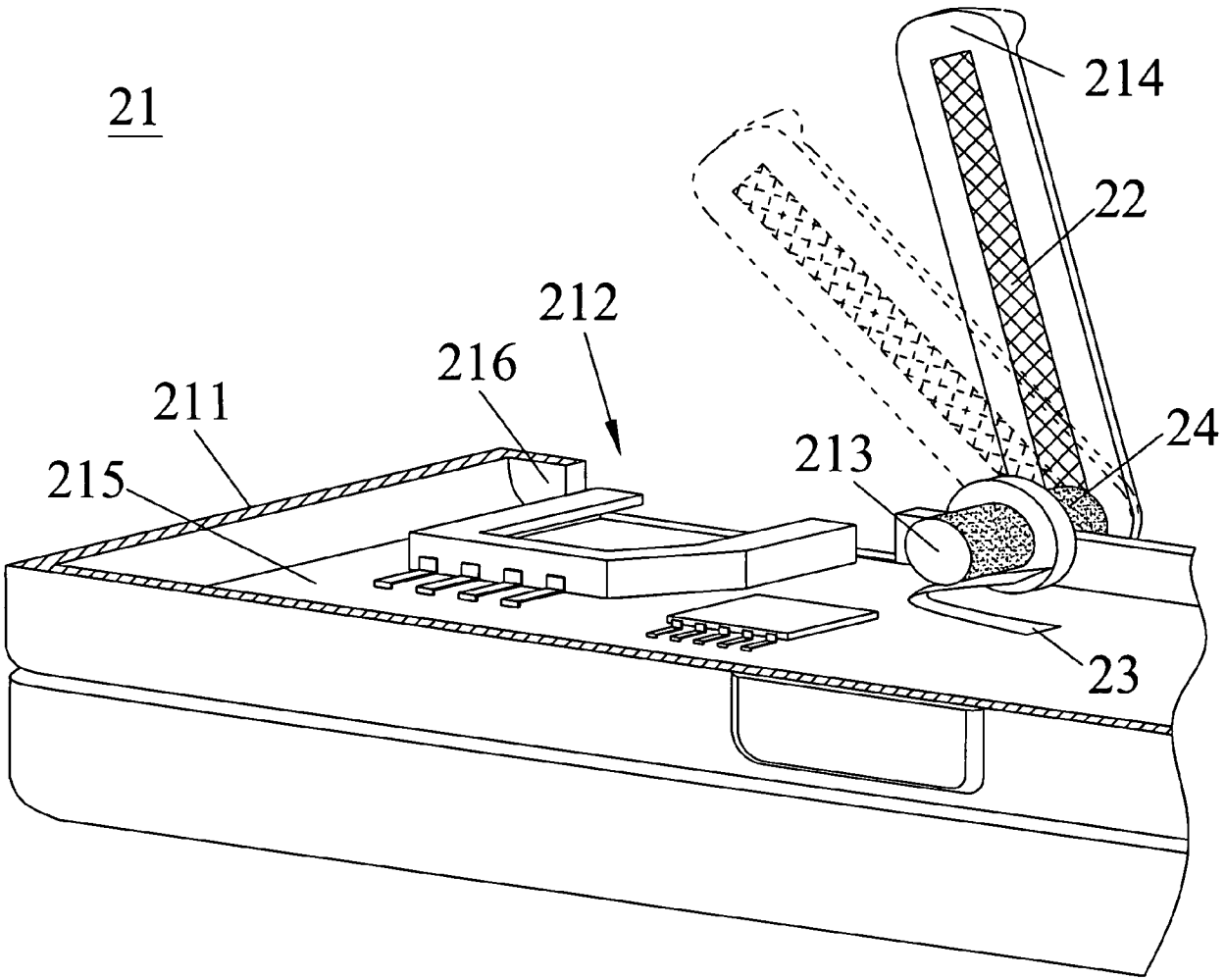
FIG. 2C is a partial enlarged perspective view showing the antenna structure for a portable electronic device according to the preferred embodiment of the present invention.

Referring to FIG. 2A, there is a perspective view showing an antenna structure for a portable electronic device according to a preferred embodiment of the present invention. Referring to FIG. 2B, there is a sectional view taken along line B-B' of FIG. 2A. Referring to FIG. 2C, there is an enlarged cutaway view showing the antenna structure for portable electronic device according to the preferred embodiment of the present invention. The portable electronic device, which is generally denoted by reference numeral 21, may be any one of a mobile phone, a personal digital assistant (PDA) and a global positioning system (GPS). In the illustrated FIG. 2A, the portable electronic device is a mobile phone. As shown, the portable electronic device 21 includes a main body 211, a slotted section 212, a shaft 213, a slot cover 214, and a printed circuit board 215. The slotted section 212 may be an input/output (I/O) port or a memory card slot and is disposed on a lateral face 216 of the main body 211. The shaft 213 couples the slot cover 214 to the main body 211 and mounted onto a peripheral wall 217 of the slotted section 212, such that the slot cover 214 is pivotally rotatable about the shaft 213 to cover or uncover the slotted section 212. The printed circuit board 215 is disposed in the main body 211. The slot cover 214 may be made of an electrical insulating material, such as a rubber, a plastic or a ceramic material. It is noted that the slot cover 214 is so positioned that it is not parallel with the printed circuit board 215.

In the illustrated preferred embodiment, the antenna structure of the present invention includes an antenna 22 and an electrical connection element 23. The antenna 22 may be a printed antenna being printed on the slot cover 214. The technology for antenna printing may be similar to the general screen printing. A designer can make a plate according to a pre-designed antenna pattern. A mesh density within a range from 100 to 257 meshes per inch can be selected according to actual need. Printing ink is a critical factor in antenna printing. The printing ink for antenna printing must be electrically conductive and therefore contains metals, such as silver or aluminum, as its main compositions.

The electrical connection element 23 may be a leaf spring and is disposed at an end of the shaft 213 opposite to the slot cover 214 with two ends of the electrical connection element 23 in contact with the shaft 213 and the printed circuit board 215, respectively, as can be seen in FIG. 2C.

The shaft 213 has a surface coating 24 capable of electrically coupling the antenna 22 to the electrical connection element 23. Therefore, a signal received by the antenna 22 can be transmitted to the electrical connection element 23 via the surface coating 24 and then to the printed circuit board 215 via the electrical connection element 23. Similarly, a signal can be transmitted from the printed circuit board 215 to the antenna 22 via the electrical connection element 23 and the surface coating 24, and then sent out from the antenna 22. The slot cover 214 is pivotally coupled to the main body 211 via the shaft 213. By rotating the slot cover 214 about the shaft 213, the antenna 22 may be adjusted to an optimal position for receiving and transmitting the signal.

In brief the antenna structure for portable electronic device according to the present invention includes an antenna that is printed on a slot cover pivotally coupled to a main body of the portable electric device and is not parallel with a printed circuit board located in the main body. Therefore, it is able to overcome the problem of an expanded volume of the conventional portable electronic device due to a relatively large clearance distance required between the antenna and the printed circuit board in the portable electronic device to avoid possible electromagnetic interference.

The present invention has been described with a preferred embodiment thereof, and it is understood that many changes and modifications in the described embodiment can be carried out without departing from the scope and the spirit of the invention that is intended to be limited only by the appended claims.

I claim:

1. An antenna structure for portable electronic device, the portable electronic device comprising a main body, a slotted section, a shaft, and a slot cover, the slot cover coupled to the main body via the shaft, and the slot cover being disposed to cover the slotted section, the antenna structure comprising:

an antenna disposed on the slot cover; and an electrical connection element coupled to the shaft and a printed circuit board disposed in the main body, wherein the antenna is electrically coupled to the printed circuit board mounted in the main body via the electrical connection element, the slotted section is disposed on a lateral face of the main body, the slot cover is pivotally rotatable about the shaft to cover or uncover the slotted section and the antenna is a printed antenna, the slotted section is selected from a group consisting of an I/O port and a memory card slot.

2. The antenna structure as claimed in claim 1, wherein the slot cover is made of an electrical insulating material.

3. The antenna structure as claimed in claim 2, wherein the electrical insulating material is selected from a group consisting of a rubber material, a plastic material, and a ceramic material.

4. The antenna structure as claimed in claim 1, wherein the shaft comprises a surface coating capable of electrically coupling the antenna to the electrical connection element.

5. A portable electronic device, comprising a main body and an antenna, the main body comprising a slotted section and a slot cover coupled to the main body via a shaft, the portable electronic device being characterized in that the antenna is disposed on the slot cover, the shaft is coupled to an electrical connection element, and the antenna is electrically coupled to a printed circuit board mounted in the main body via the electrical connection element, wherein the slotted section is disposed on a lateral face of the main body, the slot cover is pivotally rotatable about the shaft to cover or uncover the slotted section and the antenna is a printed antenna, the slotted section is selected from a group consisting of an I/O port and a memory card slot.

6. The portable electronic device as claimed in claim 5, wherein the slot cover is made of an electrical insulating material.

7. The portable electronic device as claimed in claim 6, wherein the insulating material is selected from a group consisting of a rubber material, a plastic material, and a ceramic material.

8. The portable electronic device as claimed in claim 5, wherein the shaft comprises a surface coating capable of electrically coupling the antenna to the electrical connection element.

* * * * *